US006054960A

United States Patent [19]

Tolson et al.

[11] Patent Number: 6,054,960

[45] Date of Patent: Apr. 25, 2000

[54] RETRACTABLE ANTENNA FOR A MOBILE TELEPHONE

[75] Inventors: Nigel James Tolson; Leonidas Ivrissimtzis, both of Berkshire, United Kingdom

[73] Assignee: NEC Corporation, Tokyo, Japan

[21] Appl. No.: 09/197,027

[22] Filed: Nov. 20, 1998

[30] Foreign Application Priority Data

Nov. 20, 1997 [GB] United Kingdom ..... 9724445

[51] Int. Cl.[7] ..... H01Q 1/24

[52] U.S. Cl. ..... 343/702; 343/895

[58] Field of Search ..... 343/702, 895, 343/882

[56] References Cited

U.S. PATENT DOCUMENTS

| | | | |
|---|---|---|---|
| 3,863,405 | 2/1975 | Leiter | 52/108 |
| 4,375,642 | 3/1983 | Dorrie et al. | 343/895 |
| 4,435,716 | 3/1984 | Zandbergen | 343/895 |
| 4,447,816 | 5/1984 | Kurina | 343/895 |
| 4,725,845 | 2/1988 | Phillips | 343/702 |
| 5,198,831 | 3/1993 | Burrell et al. | 343/895 |
| 5,541,617 | 7/1996 | Connolly et al. | 343/895 |
| 5,828,348 | 10/1998 | Tassoudji et al. | 343/853 |
| 5,872,549 | 2/1999 | Huynh et al. | 343/895 |

FOREIGN PATENT DOCUMENTS 2 106 717 9/1981 United Kingdom .

*Primary Examiner*—Don Wong
*Assistant Examiner*—Tan Ho
*Attorney, Agent, or Firm*—Scully, Scott, Murphy & Presser

[57] ABSTRACT

An antenna for a mobile telephone for applying to an ordinary gain antenna for GSM and a high gain antenna for ICO. The antenna comprises a strip of flexible insulating material having provided thereon a plurality of lines of conductive material, the strip is formed into a roll with one end at the outside of the roll and the other end inside the roll, the other end is drawable from the roll to extend the strip into an elongated conical shape.

9 Claims, 3 Drawing Sheets

FIG. 1
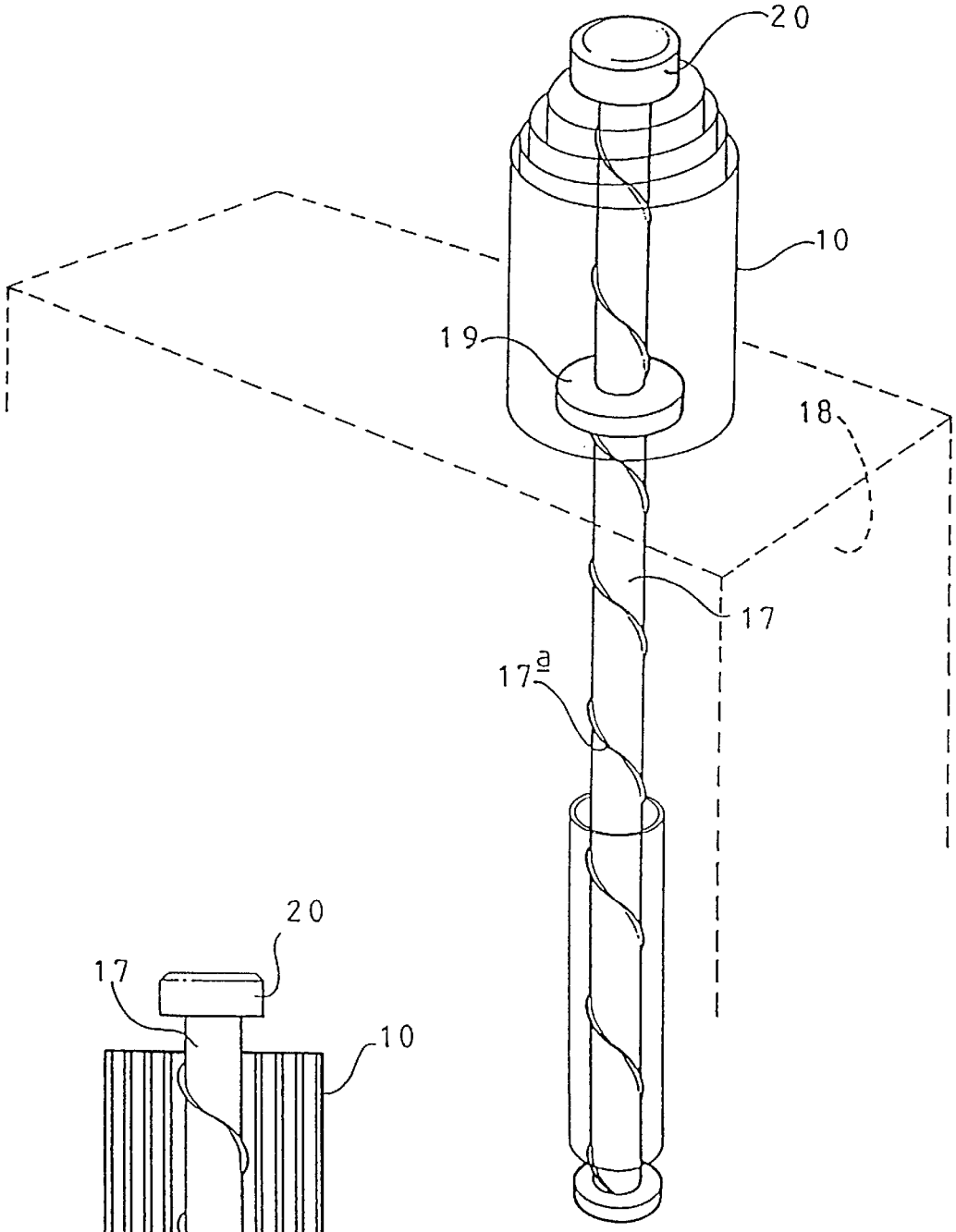
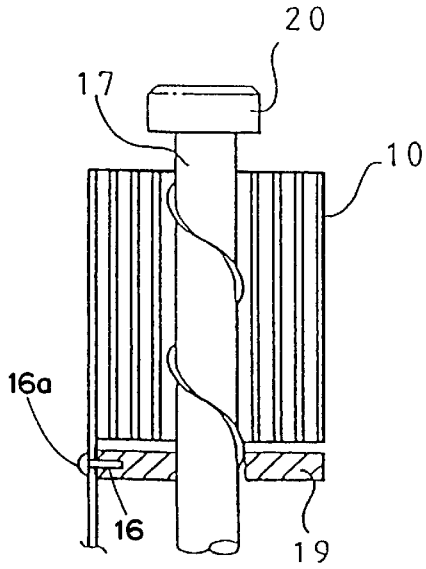
FIG. 2

RETRACTABLE ANTENNA FOR A MOBILE TELEPHONE

BACKGROUND OF THE INVENTION

1. Field of the Invention

This invention relates to a retractable antenna for a hand held mobile telephone.

It is now becoming a requirement for mobile telephones to be able to communicate with both fixed terrestrial base stations and with orbiting satellite base stations. Antennas for satellite reception are typically larger than those used for terrestrial reception—for example an antenna for a medium earth orbit satellite (MEO) is typically 10 cms long and 1 cm in diameter and usually consists of two or four conductors in helical arrangement for transmitting and receiving a circularly polarized wave. Such an antenna could be retracted only by folding it down the side of the phone housing and it is therefore very unsuitable for a modern compact mobile telephone.

2. Brief Summary of the Invention

It is an object of the present invention to provide a retractable antenna construction capable of being used for satellite communication but in a form suitable for use on a compact mobile telephone.

An antenna in accordance with the invention comprises a strip of flexible insulation material having provided thereon a plurality of lines of conductive material, the strip being formed into a roll with one end at the outside of the roll and the other end inside the roll, said other end being drawable from the roll to extend the strip into an elongated conical shape.

In the rolled condition, the antenna is suitable for used for GSM and weak satellite signals. In the extended position, the conductive lines form a tapering helical array suitable for use as a high gain ICO satellite antenna which enable to transmit and receive a circularly polarized wave.

Guide means are preferably provided for controlling the movement of the strip between its extended and retracted positions.

Such guide means may be in the form a threaded rod extending through the centre of the roll into the interior of the phone housing on which the antenna is mounted. The rod engages with a fixed nut on the housing so that it rotates in a predetermined manner as the rod is withdrawn from the housing, the rod be coupled to the inner end of the strip so as draw it outwardly as the rod is withdrawn.

BRIEF DESCRIPTION OF THE DRAWINGS

In the accompanying drawings.

FIG. 1 is a diagrammatic perspective view of one example of an antenna in accordance with the invention;

FIG. 2 is a diagrammatic perspective view showing the mounting of the antenna on the housing of a mobile phone.

DETAILED DESCRIPTION OF THE INVENTION

Figure 3:
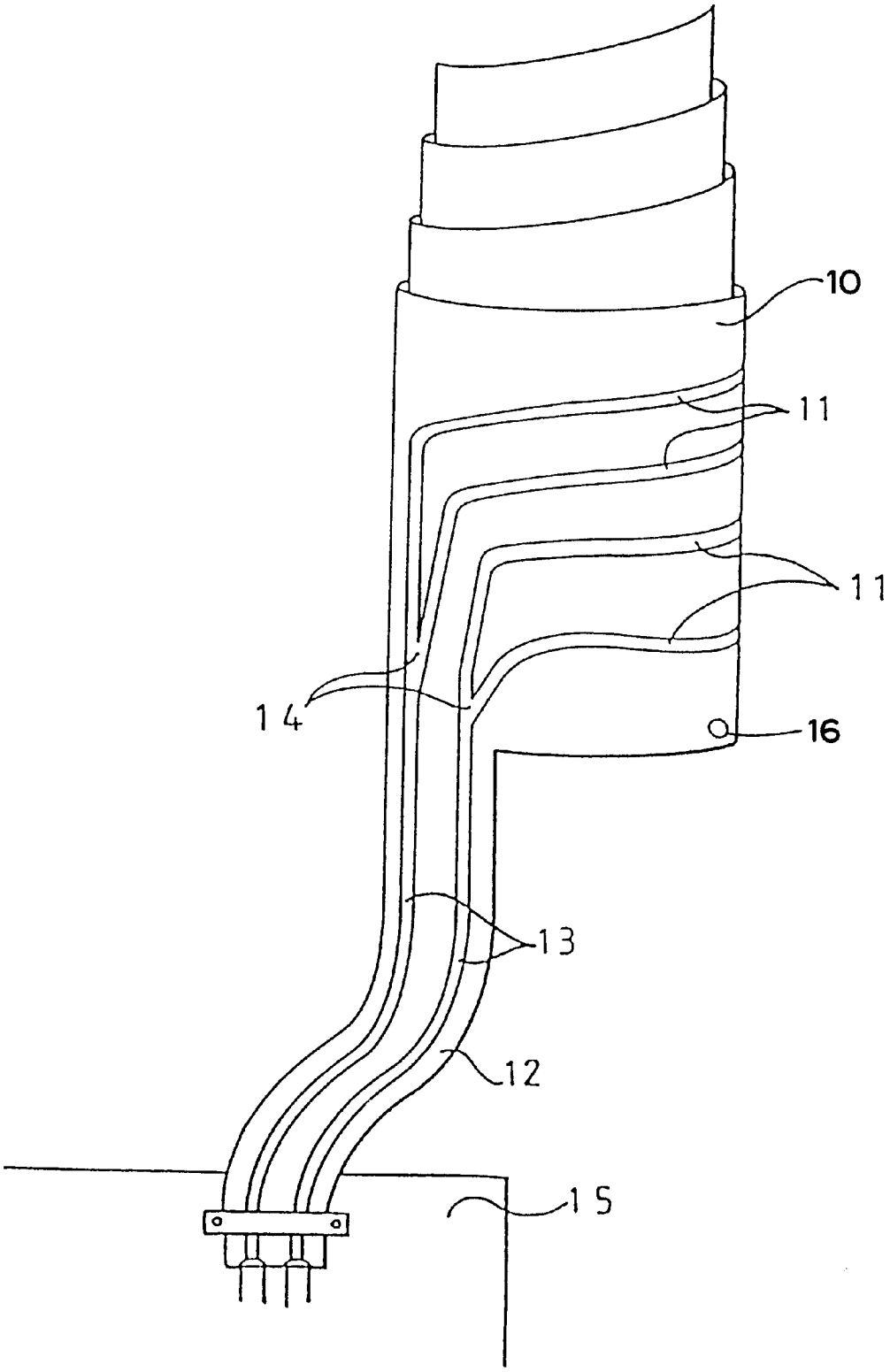
FIG. 3 is a diagrammatic perspective view showing the connection of conductive lines on the strip to the electrical circuitry of a phone.

Referring firstly to FIG. 1, the antenna comprises an elongate strip of flexible insulating material such as strip 10 of flexible printed circuit substrate material. Formed on this strip is a series of parallel lines 11 of flexible conductive material, such as thin copper foil lines. Preferably there are four such lines which are parallel to one another and extend along the length of the flexible strip 10. The strip 10 is provided at one end with a flexible extension 12 as shown in FIG. 3. The four lines 11 on the strip are merged into two lines 13 on the extension at microstrip splitters 14 on the strip 10. The extension 12 is clamped to a printed circuit board 15 within the mobile telephone case and the two lines 13 are soldered to pads on the printed circuit board.

Adjacent the splitters 14 on the strip, there is provided on the strip 11 a pivot 16 which extends into a hole in a nut 19 on the phone housing to form a pivotal connection. The strip 10 is formed into roll with the pivot boss 16*a* on the outside. In its rolled condition the strip has one end within the roll and this end can be drawn out to extend the antenna into an elongated cone. This inner end of the strip is connected to one end of a guide rod 17 which extends through the roll into the interior of the mobile telephone hosing 18. The rod is formed with a raised helical thread $\mathbf{17}^a$ which co-acts with the fixed nut 19 on the housing 18. When the rod 17 is pulled out of a housing using a knob 20 on the end of the rod 17, the rod 17 is twisted in a predetermined fashion because of the engagement of the thread $\mathbf{17}^a$ with the nut 19, so that the end of the strip is guided as it the antenna is extended to ensure that the proper conical extended shape is achieved. The pivotal connection between the outer end of the strip 10 and the housing allows the end of the strip 10 to tip as the antenna extends.

Figure 4:
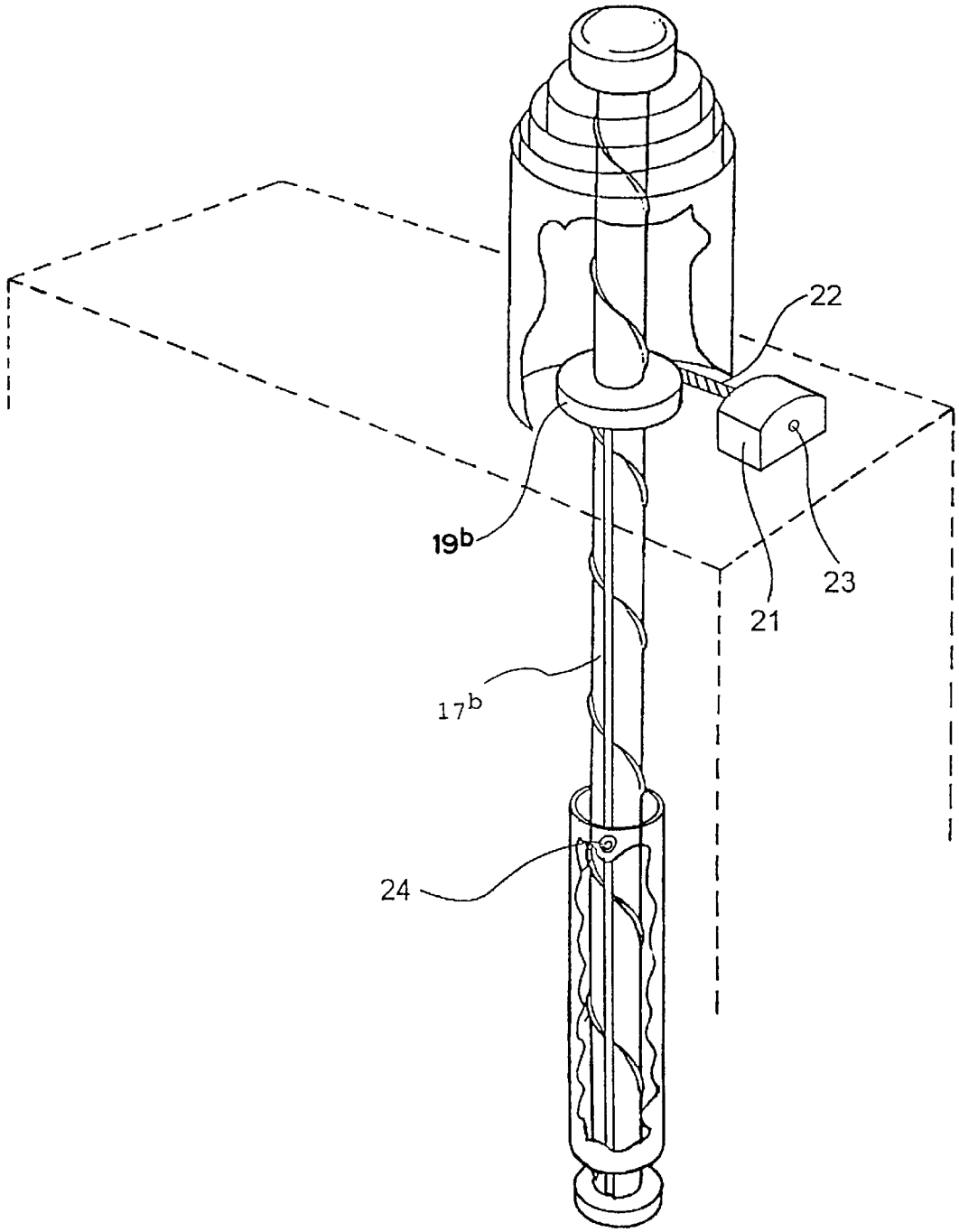
FIG. 4 is a diagrammatic perspective view showing another embodiment of an antenna in accordance with the present invention.

FIG. 4 shows another embodiment of the antenna in accordance with the present invention. Rod $\mathbf{17}^b$ is driven up and down by the rotation of nut $\mathbf{19}^b$ which is fixed rotatably fixed at the place and rotated by motor 21 trough bolt 22. Rod $\mathbf{17}^b$ has straight notch along its axis to prevent the rotation of rod $\mathbf{17}^b$ with latch 24 which project into the notch.

What is claimed is:

1. An extendable and retractable antenna for a mobile telephone comprising a strip of flexible insulating material having provided thereon a plurality of lines of conductive material, the strip being formed into a roll having multiple turns coiled about a central axis, with an outer end of the strip at the outside of the roll and an inner end of the strip at the inside the roll, with the inner end being withdrawable from the roll in a direction along the central axis to extend the strip into an elongated conical shape which is concentric about the central axis.

2. An extendable and retractable antenna as claimed in claim 1, wherein the strip is formed on flexible printed circuit material.

3. An extendable and retractable antenna as claimed in claim 1, further including a guide means for rotating said inner end of the strip as it is withdrawn from the roll.

4. An extendable and retractable antenna as claimed in claim 3, wherein said guide means comprises a guide rod extending through the roll and having thereon a thread engaged with a nut which is fixed relative to a housing of the mobile telephone.

5. An extendable and retractable antenna as claimed in claim 4, wherein the guide rod is formed with a raised helical thread which co-acts with threads in the fixed nut, and when the rod is extended from the housing, the rod is twisted because of engagement of the helical thread with the fixed nut, and the inner end of the strip is rotated and guided to extend the strip into the elongated conical shape.

6. An extendable and retractable antenna as claimed in claim 3, wherein said guide means comprises a nonrotatable guide rod extending through the roll and having thereon a thread engaged with a nut which is rotatably mounted relative to a housing of the mobile telephone, and wherein the nut is rotated by a motor whose rotational direction is reversible.

7. An extendable and retractable antenna as claimed in claim 1, wherein the inner end of the strip is connected to one end of a guide rod which extends along the central axis through the roll and into the interior of a housing for the mobile telephone, and the guide rod is extendable along the central axis.

8. An extendable and retractable antenna as claimed in claim 1, wherein the outer end of the flexible strip is provided with a flexible extension which is clamped to a printed circuit board within a housing of the mobile telephone, and lines of conductive material are soldered to connections on the printed circuit board.

9. An extendable and retractable antenna as claimed in any preceding claim, wherein the outer end of the rolled strip is pivotally connected relative to a housing of the mobile telephone, such that the pivotal connection between the outer end of the strip and the housing allows the outer end of the strip to tip as the strip is being extended.

* * * * *